US008529051B2

(12) United States Patent
Fujikura et al.

(10) Patent No.: US 8,529,051 B2
(45) Date of Patent: Sep. 10, 2013

(54) PAPER SEASONING APPARATUS AND INKJET RECORDING APPARATUS

(75) Inventors: Tatsuo Fujikura, Kanagawa (JP); Yuhei Chiwata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 295 days.

(21) Appl. No.: 13/170,198

(22) Filed: Jun. 28, 2011

(65) Prior Publication Data

US 2011/0316949 A1 Dec. 29, 2011

(30) Foreign Application Priority Data

Jun. 29, 2010 (JP) ..... 2010-147953

(51) Int. Cl.
*B41J 2/01* (2006.01)

(52) U.S. Cl.
USPC ..... 347/102; 347/104

(58) Field of Classification Search
None
See application file for complete search history.

(56) References Cited

FOREIGN PATENT DOCUMENTS

JP 6-239514 A 8/1994

*Primary Examiner* — Stephen Meier
*Assistant Examiner* — Tracey McMillion
(74) *Attorney, Agent, or Firm* — SOLARIS Intellectual Property Group, PLLC

(57) ABSTRACT

The present invention provides a paper seasoning apparatus and an inkjet recording apparatus including a paper seasoning apparatus, capable of seasoning paper configured in a paper stack, and separating the paper stacks by introducing separation plates between sheets of the paper. Namely, separation plates for separating paper into specific numbers of sheets are introduced from a plate feeding apparatus into a housing of a paper seasoning apparatus. A separation plate lowering device lowers the separation plate that is supporting a paper stack. Seasoning is performed by blowing air from an air blowing device against the paper stack.

14 Claims, 4 Drawing Sheets

PAPER SEASONING APPARATUS AND INKJET RECORDING APPARATUS

CROSS-REFERENCE TO RELATED APPLICATION

This application claims priority under 35 USC 119 from Japanese Patent Application No. 2010-147953, filed on Jun. 29, 2010 the disclosure of which is incorporated by reference herein.

BACKGROUND

1. Technical Field

The present invention relates to a paper seasoning apparatus and an inkjet recording apparatus. Particularly, the present invention relates to a paper seasoning apparatus for blowing air onto a side face of a stack of paper, and an inkjet recording apparatus including the paper seasoning apparatus.

2. Related Art

Papers that have been recorded with image by an image recording apparatus, such as inkjet recording apparatus, are configured into paper stacks. Such paper stacks are configured with, for example, separation plates inserted between sheets of paper to separate the paper every specific number of sheets. For example, Japanese Patent Application Laid-Open (JP-A) No. 6-239514 discloses an automatic blanking device in which a sensor detects when the number of sheets of paper stacked on a blanking plate has reached a specific number, and the blanking plate is then lowered by a fixed amount.

Sometimes expansion and contraction of paper occurs just after the paper has been recorded with an image by an inkjet recording apparatus. This expansion and contraction of paper are due to the presence of portions within a single sheet of paper, where there is a lot of ink (moisture content) and portions where there is little thereof. Consequently, humidity conditioning (called seasoning) of the paper is preferably performed by supplying air onto the plural sheets of paper (paper stack). However, if this results in the need for an operation to carry the paper stacks from an inkjet recording apparatus to a paper seasoning apparatus then this increases the workload on an operative.

SUMMARY

The present invention provides a paper seasoning apparatus and an inkjet recording apparatus including the paper seasoning apparatus, capable of both separating paper into paper stacks by introducing separation plates between sheets of the paper, and seasoning the paper configured in the paper stacks.

A first aspect of the present invention is a paper seasoning apparatus including: a paper housing section that stacks and houses sheets of paper that have been recorded with an image; a separation plate introduction section that introduces separation plates into the paper housing section for separating stacked paper into paper stacks; a separation plate support section that supports a plurality of the separation plates, and provides intervals between the separation plates greater than the stacked height of the paper stack; and an air blowing section that blows air onto a side face of the paper stacks separated by the separation plates in the paper housing section.

Such a paper seasoning apparatus stacks and houses sheets of paper that have been recorded with images in the paper housing section. In order to configure paper stacks, separation plates are then introduced by the separation plate introduction section for separating the sheets of paper into paper stacks with the separation plates. Plural separation plates are supported by a separation plate support section and the interval between the separation plates is made greater than the stacked height of the paper stacks. Seasoning can be efficiently performed to the paper by blowing air with the air blowing section onto the side face of the paper stacks while in this state. Namely, such a paper seasoning apparatus enables both the separation plates to be introduced between sheets of paper to configure paper stacks and also seasoning to be performed to the paper configured in paper stacks.

A second aspect of the present invention, in the first aspect, the separation plate support section may lower the separation plate by a lowering amount that matches the increase in height of the stack height of the paper stack.

Accordingly, by lowering the separation plates by an amount that matches the increase in stack height of the paper stacks, the paper may be smoothly housed in the paper housing section without the paper colliding with the side face of the already housed paper stack.

A third aspect of the present invention, in the second aspect, the air blowing section may blow air onto the side face of the paper stack while the paper stack is being lowered.

Accordingly, efficient seasoning may be possible by performing seasoning while the paper stacks are being lowered.

A fourth aspect of the present invention, in either the second or the third aspect, the separation plates may be configured by a bottom separation plate on which the paper stack is stacked, and a top separation plate disposed above the bottom separation plate, and the bottom separation plate and the top separation plate may be lowered such that the interval between the bottom separation plate and the top separation plate is provided greater than the stack height of the stacked paper.

Consequently, each of the paper stacks can be surrounded below and above by a bottom separation plate and a top separation plate, enabling seasoning to be performed while also suppressing the paper from thrashing around. The interval between the bottom separation plate and the top separation plate is set larger than the stack height of the stacked stack, and hence the separation between sheets of paper can be opened wider, ensuring that air can be blown through between the sheets of paper (passing air through).

A fifth aspect of the present invention, in the fourth aspect, the separation plate support section may support and lower the bottom separation plate and the top separation plate, and at a specific lowering position, support of the top separation plate may be released before support of the bottom separation plate is released.

The above release of support for the top separation plate is, for example, implemented at the point in time when air blowing by the air blowing section has been completed. The top separation plate approaches the bottom separation plate under its own weight due to release of support to the top separation plate, and the interval between the bottom separation plate and the top separation plate can be narrowed.

A sixth aspect of the present invention, in the fifth aspect, leg portions may be provided at the top separation plate for supporting the top separation plate on the bottom separation plate when support of the top separation plate from the separation plate support section has been released.

Consequently, even though support of the top separation plate by the separation plate support section has been released, the leg portions provided to the top separation plate make contact with the bottom separation plate and the top separation plate is thereby supported. A specific interval can thereby be configured between the bottom separation plate and the top separation plate.

A seventh aspect of the present invention, in the sixth aspect, the leg portions may be positioned at the outside of a side face of the paper stack and suppress the paper from thrashing about when air is blown from the air blowing section.

Due to the leg portions suppressing the paper from thrashing around, even more efficient seasoning may be performed while also suppressing deformation of the paper.

An eighth aspect of the present invention, in the first to the seventh aspects, the separation plates may be formed with a curve so as to protrude upwards when viewed from the air blowing section along the direction of air blow.

Accordingly, air is blown by the air blowing section onto the side face of the paper stack in a direction orthogonal to the curved direction of the bottom separation plate. Hence even if the paper has a curl initially, air can be passed between the sheets of paper and humidity conditioning achieved while the curl is being corrected.

A ninth aspect of the present invention, in the first to the eighth aspects, may further include, a cover member that surrounds the separation plate support section on four sides, wherein the cover member may be formed with an air blowing opening for introducing air blown from the air blowing section, and with an air discharge outlet for discharging air from inside the cover member.

By surrounding the separation plate support section by the cover member on four sides in this manner, the paper on the separation plate supported by the separation plate support section is not readily externally affected during air blowing by the air blowing section. The cover member is formed with the air blowing openings and the air discharge outlets and hence the cover member can be suppressed from impeding air blowing from the air blowing section (seasoning).

A tenth aspect of the present invention is an inkjet recording apparatus including: an inkjet recording apparatus main body that ejects ink droplets onto paper and records images; and the paper seasoning apparatus of the first aspect, provided at a discharge section for paper that has been recorded with images by the inkjet recording apparatus main body.

An image can be recorded on the paper with the inkjet recording apparatus main body. By then providing the paper seasoning apparatus of one of the first to the ninth aspects, paper stacks can be configured by introducing the separation plates between the sheets of paper, and also paper seasoning can be performed to the paper stacks configured by the paper. In addition the paper seasoning apparatus is provided at the discharge section of the inkjet recording apparatus main body, and so there is no requirement for an operation to carry the paper stacks from the inkjet recording apparatus main body to the paper seasoning apparatus.

According to the above aspects, the present invention may provide a paper seasoning apparatus and an inkjet recording apparatus including the paper seasoning apparatus, capable of both separating paper into paper stacks by introducing separation plates between sheets of the paper, and seasoning the paper configured in the paper stacks.

BRIEF DESCRIPTION OF THE DRAWINGS

An exemplary embodiment of the present invention will be described in detail based on the following figures, wherein.

DETAILED DESCRIPTION

Explanation follows regarding a paper seasoning apparatus 12 of a first exemplary embodiment of the present invention, and an inkjet recording apparatus 112 including the paper seasoning apparatus 12.

Figures 1A, 1B:
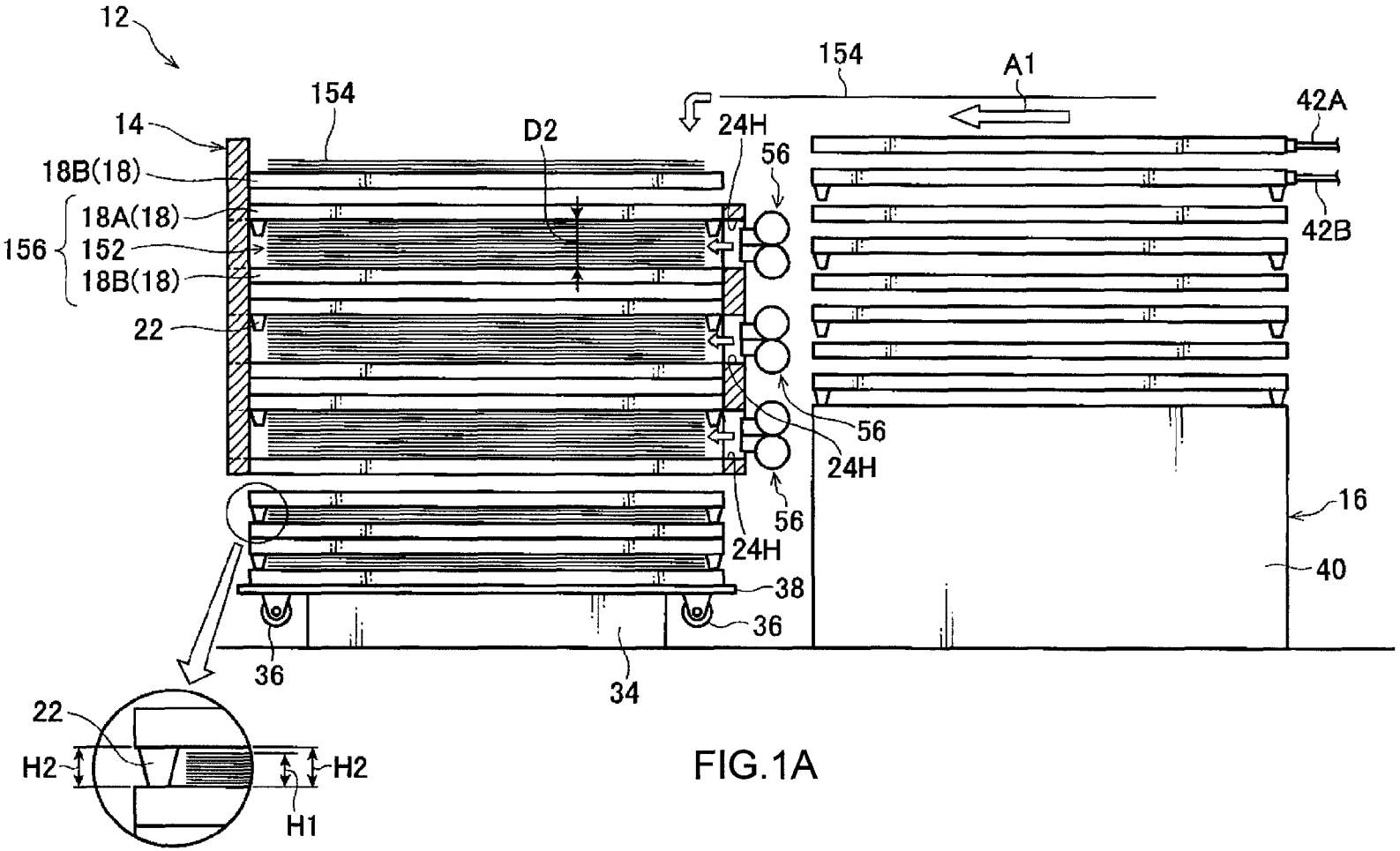
FIG. 1A is a front view illustrating an overall configuration of a paper seasoning apparatus of a first exemplary embodiment of the present invention.
FIG. 1B is a partial enlargement of a paper seasoning apparatus of the first exemplary embodiment of the present invention.

As shown in FIG. 1A and FIG. 1B, the paper seasoning apparatus 12 of the present exemplary embodiment includes a box shaped housing 14 that is open to the top and bottom, and a plate feeding apparatus 16 disposed adjacent to the housing 14. Bottom separation plates 18B and top separation plates 18A, which together configure separation plates 18 of the present invention, are disposed between plural sheets of paper 154 inside the housing 14. Namely, plural sheets of the paper 154 are separated by the bottom separation plates 18B and the top separation plates 18A into paper stacks 152 that are each configured from a specific number of sheets (for example 100 sheets) of the paper 154. Accordingly, in each of the paper stacks 152, the specific number of sheets of paper 154 are supported in a stacked state configuring a paper stack 152 on a bottom separation plate 18B, with a top separation plate 18A also disposed above the paper stack 152. Namely, the paper stack 152 is housed in a paper housing space 20 configured between the bottom separation plate 18B and the top separation plate 18A. Hereinafter, one of the paper stacks 152 together with its bottom separation plate 18B below and top separation plate 18A above, will be referred to below as a paper stack unit 156.

Figure 3A:
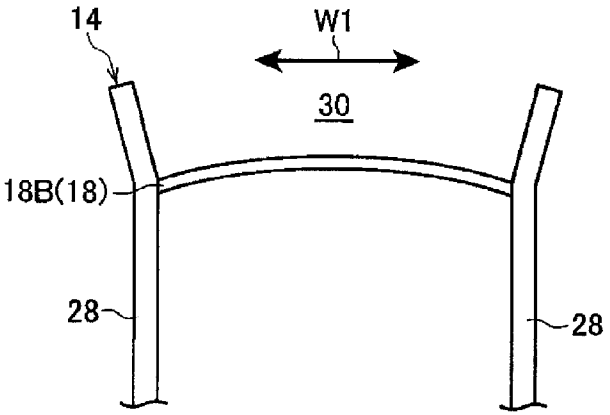
FIG. 3A to FIG. 3D are explanatory diagrams showing processing sequences for seasoning paper in a paper seasoning apparatus of the first exemplary embodiment of the present invention.
Figure 3B:
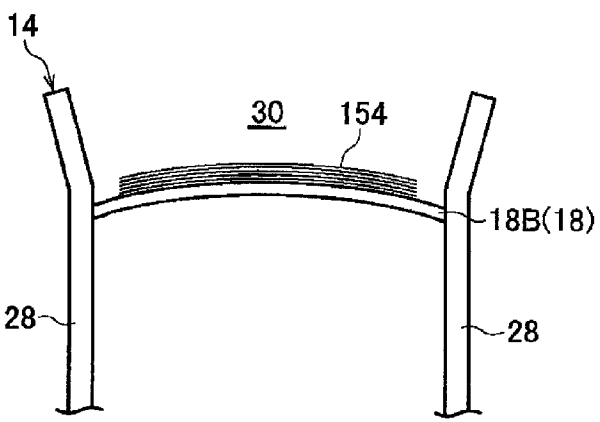
Figure 3C:
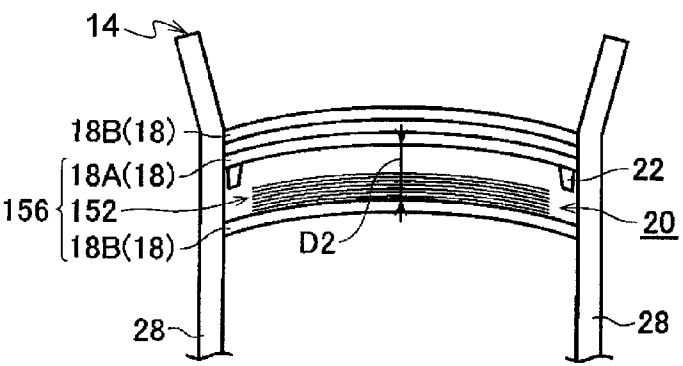
Figure 3D:
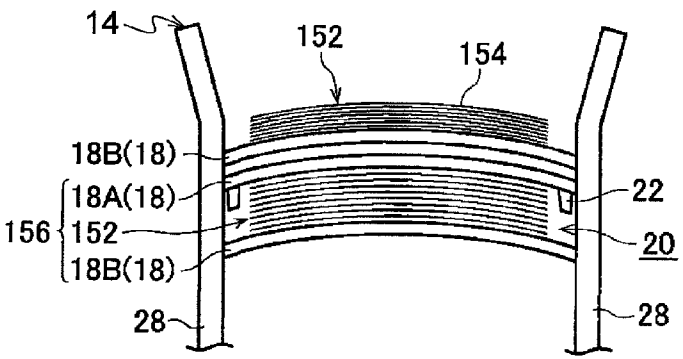

As shown in FIG. 3A and FIG. 3D, when viewed from the arrow A1 direction (the same direction as the air blowing direction from air blowing devices 56, described later), each of the bottom separation plates 18B has a shape with a raised width direction central portion and lowered at both width direction edge portions. In other words, each of the bottom separation plates 18B has an upwards facing convex shape. Curving the bottom separation plate 18B in this shape enables, for example, curl correction to be performed by bending the paper in a direction orthogonal to a curl direction, when the paper 154 that has been recorded with an image in the inkjet recording apparatus 112 adopted a curl in a particular direction. The radius of curvature of the top face of the bottom separation plate 18B is not necessarily be constant across the width direction (the arrow W1 direction), and there may be a different radius of curvature at each location on the bottom separation plate 18B.

Spacers 22 are formed, as examples of the leg portions of the present invention, protruding downwards from the bottom face of each of the top separation plates 18A near to the four corners. The spacers 22 are formed with a specific height H2, and act to ensure a specific separation (the vertical separation D1) to house the paper stack 152 between the top face of the bottom separation plate 18B and the bottom face of the top separation plate 18A. The top separation plates 18A are also configured with a similar curve to that of the bottom separation plates 18B, such that the vertical separation D1 is substantially constant across the width direction (arrow W1 direction).

Figure 2:
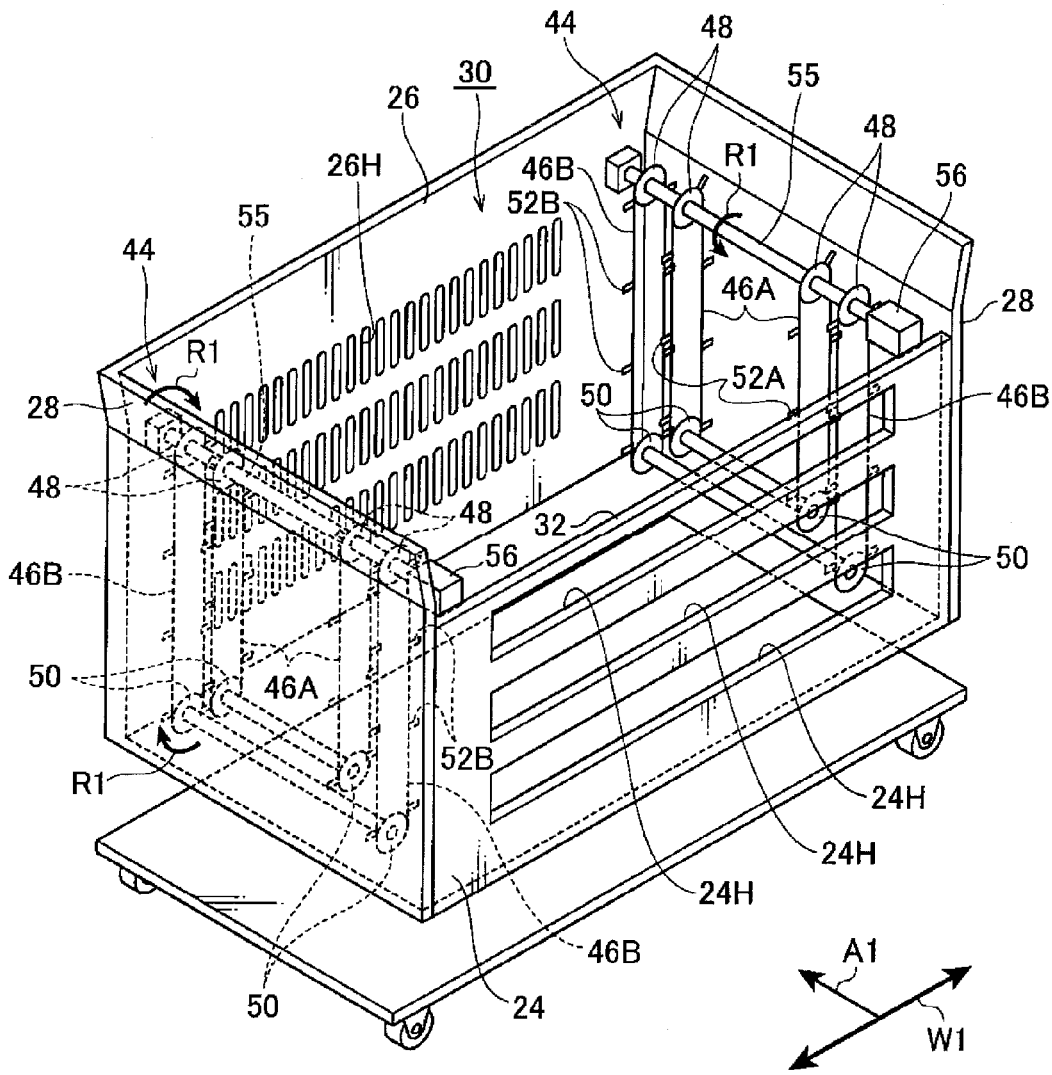
FIG. 2 is a perspective view illustrating a housing and the interior of a paper seasoning apparatus of the first exemplary embodiment of the present invention.

As shown in detail in FIG. 2, the housing 14 is formed from a front plate 24, a rear plate 26 and two side plates 28, serving as cover members of the present invention, in a frame shape as viewed from above. The housing 14 to provide a paper housing section 30 inside the frame. Sheets of the paper 154 that have been recorded with images by the inkjet recording apparatus 112 are housed in the paper housing section 30 in a stacked state. The rear plate 26 and the side plates 28 of the housing 14 have the same height as each other. However the height of the upper portion of the front plate 24 is lower than that of the rear plate 26 and the side plates 28, so as to configure a plate insertion indented portion 32.

The bottom face of housing 14 is open. A pallet support table 34 is disposed below the housing 14, as shown in FIG. 1A, and a pallet 38 with castors 36 is supported on the pallet support table 34. The paper stack units 156 are mounted on the pallet 38 when they have completed seasoning, described later.

The plate feeding apparatus 16 includes a separation plate support table 40. Plural separation plates 18 are stacked on the separation plate support table 40, alternating the bottom separation plates 18B and the top separation plates 18A. The separation plate support table 40 is raised or lowered to a height, such that the uppermost two of the separation plates 18 (a bottom separation plate 18B and a top separation plate 18A) are aligned with the plate insertion indented portion 32 of the housing 14. The uppermost two of the separation plates 18 are then each pushed in the arrow A1 direction by insertion rods 42A, 42B, such that the separation plates 18 are inserted into the housing 14 through the plate insertion indented portion 32. Note that the plate feeding apparatus 16 also includes guide members (not shown in the drawings) to prevent the separation plates 18 from unintentionally tipping or falling out, and to smoothly introduce the separation plates 18 into the housing 14.

As shown in detail in FIG. 2, a separation plate lowering device 44 is provided at the inside faces of each of the respective two side plates 28 of the housing 14. The separation plate lowering device 44 serves as a separation plate support section of the present invention. Namely, the separation plate lowering device 44 is surrounded in four directions by the front plate 24, the rear plate 26 and the two side plates 28.

The separation plate lowering device 44 has a pair of bottom separation plate lowering belts 46B disposed at the inside of each of the side plates 28 (a total of four of the bottom separation plate lowering belts 46B). The bottom separation plate lowering belts 46B are endless shaped belts entrained around upper drive pulleys 48 and lower following pulleys 50. Support fingers 52B for supporting the bottom separation plates 18B project out at fixed vertical intervals from the bottom separation plate lowering belts 46B. The support fingers 52B are capable of supporting the bottom separation plates 18B so as to be positioned in the vicinity of the corner portions of the bottom separation plate 18B introduced into the housing 14.

The separation plate lowering device 44 has a pair of top separation plate lowering belts 46A disposed at each of the side plates 28 (a total of four of the top separation plate lowering belts 46A). The top separation plate lowering belts 46A are endless shaped belts entrained around upper drive pulleys 48 and lower following pulleys 50. Support fingers 52A for supporting the top separation plates 18A project out at fixed vertical intervals from the top separation plate lowering belts 46A. The support fingers 52A are positioned in the vicinity of the corner portions of the top separation plate 18A introduced into the housing 14 and can support the top separation plates 18A.

The relative position of the support fingers 52B, 52A is set to give a vertical separation D2 between the bottom separation plates 18B and the top separation plates 18A. The vertical separation D2 is wider than the height H2 between the spacers 22 when the bottom separation plates 18B and the top separation plates 18A are in a supported state by the support fingers 52B and the support fingers 52A, respectively (the bottom ends of the spacers 22 are hence separated from the bottom separation plates 18B). The fixed vertical separation D2, wider than the height H2 of the spacers 22, configured between the top faces of the bottom separation plates 18B and the bottom faces of the top separation plates 18A in the state in which the bottom separation plates 18B and the top separation plates 18A, are supported by the support fingers 52B, 52A, respectively. This state is then maintained while the bottom separation plates 18B and the top separation plates 18A are lowered.

The drive pulleys 48 are coupled together by dive shafts 55, so as to be rotated as one in the arrow R1 direction by drive motors 54. The bottom separation plates 18B and the top separation plates 18A are maintained with the above specific vertical separation D2 while they are being lowered at a constant lowering speed by rotation driving the drive pulleys 48. The lowering amount here (lowering speed) is set to match the increase in height of the paper 154, as the sheets of the paper 154 are successively housed in the paper housing section 30. Namely, a lowering amount of the height of one sheet of the paper 154 is made during the period (time separation) from feeding in one sheet of the paper 154 to feeding in the next sheet of the paper 154.

The following pulleys 50 of the top separation plate lowering belts 46A are set higher than the following pulleys 50 of the bottom separation plate lowering belts 46B. Accordingly, when the bottom separation plates 18B and the top separation plates 18A are being lowered while maintaining the above vertical separation D2, the support fingers 52A first reach the following pulleys 50 and from then onwards separate from the respective top separation plate 18A, releasing support of the top separation plate 18A. The top separation plate 18A is consequently lowered under their own weight, until the bottom ends of the spacers 22 make contact with the top face of the respective bottom separation plate 18B. The bottom separation plate 18B and the top separation plate 18A thereby adopt a vertical separation H1 that is substantially equivalent to that of the height H2 of the spacers 22 (see FIG. 1B). Then, when the support fingers 52B reach the following pulleys 50 the support fingers 52B from then onwards separated from the bottom separation plates 18B, releasing the support of the bottom separation plate 18B. The paper stack units 156 are accordingly mounted onto the pallet 38 (namely mounted above a paper stack unit 156 when there is already a paper stack unit 156 mounted on the pallet 38).

As shown in FIG. 1A and FIG. 1B, plural air blowing devices 56 are disposed at the housing 14 in positions further outside than the front plate 24. Air blowing openings 24H are formed in the front plate 24 for introducing air blown from the air blowing devices 56 into the housing 14. Air discharge outlets 26H are also formed in the rear plate 26 for externally discharging air. As an example of the air blowing openings 24H in the present exemplary embodiment, there are about 5 to 7 rows of air blowing openings 24H formed along the horizontal direction, and the vertical direction is disposed with 3 rows of the air blowing devices 56. The air discharge outlets 26H are, for example, formed by dividing into many slits on progression along the width direction, positioned so as to substantially align with the air blowing openings 24H.

The air blowing openings 24H may be formed to correspond to individual air blowing devices 56. However, the air blowing openings 24H of the present exemplary embodiment are configured with elongated shapes along the horizontal direction, divided for each of the air blowing devices 56 along the height direction but common to all of the air blowing devices 56 along a given horizontal direction (resulting in 3 rows of the air blowing openings 24H being formed along the height direction). The air discharge outlets 26H are divided for each of the air blowing devices 56 along the height direction. Forming the air blowing openings 24H and the air discharge outlets 26H in this manner, enables air similar to that of in the peripheral atmosphere (similar temperature and humidity) to be blown from the air blowing devices 56 against a side face of the paper stacks 152, as the separation plates 18 (the paper stack units 156) are being lowered by the separation plate lowering device 44. This provides an action that acclimatizes (seasons) the paper configuring the paper stacks 152 to the peripheral environment.

Figure 4:
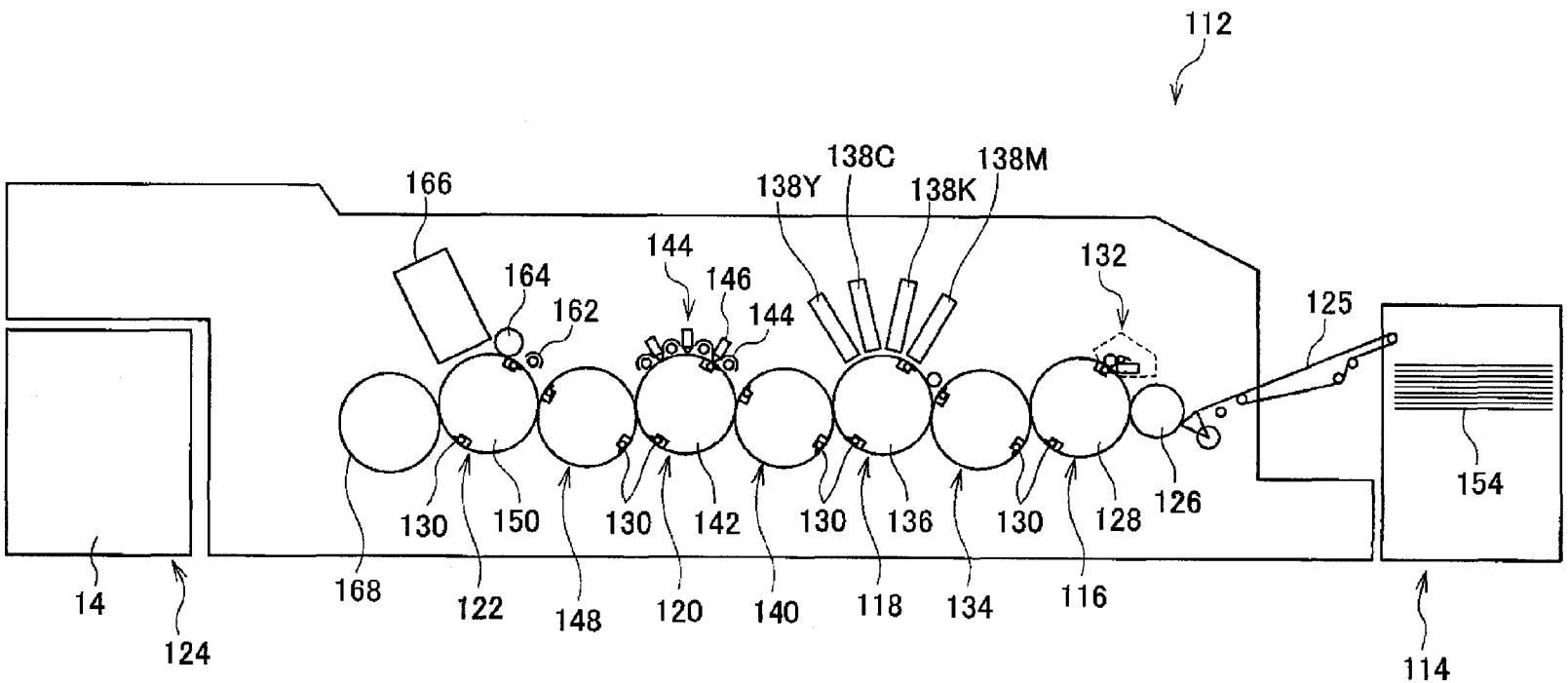
FIG. 4 is a front view illustrating an outline configuration of an inkjet recording apparatus including a paper seasoning apparatus of the first exemplary embodiment of the present invention.

FIG. 4 illustrates the inkjet recording apparatus 112 as an example of an application of the paper seasoning apparatus 12 of the present invention. The inkjet recording apparatus 112 includes a paper feeder 114, a processing liquid coating section 116, an image recording section 118, a drying section 120, a fixing section 122 and a paper discharge section 124. The inkjet recording apparatus 112 records an image on the paper 154 as the paper 154 is being conveyed along sequentially to the position of each of the above.

The paper 154 is stacked in the paper feeder 114 and the paper feeder 114 feeds out the paper 154 one sheet at a time. The paper 154 that has been fed out is conveyed via a paper feed tray 125 and a paper feed drum 126 to the processing liquid coating section 116. A processing liquid coating drum 128 is rotatably disposed in the processing liquid coating section 116. The paper 154 is conveyed downstream by rotation of the processing liquid coating drum 128, with the leading edge of the paper 154 in a retained state by a retaining member 130. Processing liquid is coated onto the paper 154 by a processing liquid coating device 132 disposed above the processing liquid coating drum 128. Configuration may, as required, include a processing liquid drying apparatus to actively dry the processing liquid. The processing liquid reacts with ink, thereby acting to aggregate coloring matter (pigment) and promote separation of coloring matter (pigment) from the liquid medium.

The paper 154 is then fed via a conveying drum 134 to the image recording section 118. In the image recording section 118, the paper 154 is conveyed while retained on an image recording drum 136, and an image is recorded on a face of the paper 154 by impacting ink droplets ejected from an inkjet recording head 138 disposed above the image recording drum 136. More precisely, there are four colors of inkjet recording heads 138 in the present exemplary embodiment, for the basic colors of yellow (Y), magenta (M), cyan (C) and black (K), disposed along the circumferential direction of the image recording drum 136. Each of the inkjet recording heads 138 has an ink jetting range corresponding to the maximum width of the paper 154, namely they are full-line heads.

The paper 154 is then conveyed via a conveying drum 140 to the drying section 120. The paper 154 is conveyed in the drying section 120 while retained on a drying drum 142. Halogen heaters 144 and warm air nozzle 146 are disposed above the drying drum 142. The ink on the paper 154 is dried by heat from the halogen heaters 144 and warm air from the warm air nozzles 146 as being conveyed by the drying drum 142.

The paper 154 is then fed via a conveying drum 148 to a fixing section 122. In the fixing section 122, the image (ink) is fixed by being heated by a halogen heater 162 (preparatory heating) and pressed by a fixing roller 164, as the paper 154 is being conveyed while retained on a fixing drum 150. A check pattern on the paper 154 and the moisture content, surface temperature and glossiness are then measured by an in-line sensor 166.

The paper 154 that has been recorded with an image in the manner described above is then conveyed by a discharge roller 168, and is discharged from the inkjet recording apparatus 112 via the paper discharge section 124. The paper seasoning apparatus 12 is provided at the paper discharge section 124, and the image recorded paper is then seasoned in the paper seasoning apparatus 12.

Configuration is made such that the paper 154 is fed one sheet at a time into the paper housing space 20 of the paper seasoning apparatus 12, with the paper stack 152 formed by stacking the plural sheets of the paper 154 when they are in the paper housing space 20.

Explanation now follows regarding a method of seasoning the paper 154 by blowing air at a side face of the paper stack 152 using the paper seasoning apparatus 12 of the present exemplary embodiment, and regarding operation of the paper seasoning apparatus 12.

In the paper seasoning apparatus 12, in order to separate the paper 154 into specific numbers of sheets with the separation plates 18 (the bottom separation plates 18B and the top separation plates 18A), first a sufficient number of the bottom separation plates 18B and the top separation plates 18A are stacked alternately on the separation plate support table 40.

Then prior to housing the sheets of the paper 154 that have completed image recording in the paper housing section 30, as shown in FIG. 3A, one of the bottom separation plates 18B is set in the housing 14. The drive motors 54 are then driven, circulating the bottom separation plate lowering belts 46B and the top separation plate lowering belts 46A, and moving the support fingers 52B, 52A downwards. When the bottom separation plate 18B is supported on the support fingers 52B, the bottom separation plate 18B is lowered at a lowing speed of the height of a single sheet of the paper 154 during the cycle (time separation) for feeding in successive sheets of the paper 154.

In this state, as shown in FIG. 3B, the sheets of the paper 154 that have been recorded with images by the inkjet recording apparatus 112 are fed successively into the paper housing section 30 and stacked. An operative does not need to carry the image recording completed paper to the paper seasoning apparatus 12 due to provision of the paper seasoning apparatus 12 at the paper discharge section 124 in the inkjet recording apparatus 112.

Furthermore, due to the bottom separation plate 18B being lowered at the specific lowering speed, the sheets of the paper 154 newly fed in do not unintentionally collide with the side face of the sheets of the paper 154 that have already been stacked on the bottom separation plate 18B, and the sheets of the paper 154 can be smoothly housed in the paper housing section 30.

When the number of the sheets of the paper 154 reaches a specific number for configuring one of the paper stacks 152, the insertion rods 42A, 42B of the plate feeding apparatus 16 are driven. Then, as shown in FIG. 3C, the top separation plate 18A and the bottom separation plate 18B are inserted into the paper housing section 30. The top separation plate 18A and bottom separation plate 18B are supported by the support fingers 52A and the support fingers 52B, respectively. The top separation plate 18A is accordingly positioned above the paper stack 152, and the paper stack unit 156 is configured with the paper stack 152 in a housed state between the bottom separation plate 18B and the top separation plate 18A in the paper housing space 20.

The vertical separation D2 between the top separation plate 18A and the bottom separation plate 18B above and below the paper stack 152 is set wider than the stack height H1 of the paper stack 152 when in its natural state (see FIG. 1B). The paper stack unit 156 is lowered while this state is maintained, and air from the air blowing devices 56 is blown against the side face of the paper stack 152. As shown in FIG. 1A, FIG. 1B and FIG. 3D, the air is caused to pass between the sheets of the paper 154, and the paper 154 can be acclimatized to the peripheral environment (seasoned). More specifically, seasoning in the present exemplary embodiment is performed while the paper stack 152 is being lowered. Namely, continuous seasoning may be performed in turn to plural successive paper stacks 152.

Furthermore, due to the top separation plate 18A facing the top of the paper stack 152, seasoning may be performed while suppressing the paper 154 from thrashing around unintentionally. However, since the spacers 22 of the top separation plate 18A are disposed at the side of the paper stack 152, movement in the horizontal direction and thrashing about of the sheets of the paper 154 may also be suppressed. Accordingly, this enables seasoning to be performed more efficiently than is the case in configurations not provided with the spacers 22. Deformation of the paper 154 caused by such movement and thrashing about may also be suppressed.

The paper 154 that has been image recorded by the inkjet recording apparatus 112 is then similarly fed in onto the next bottom separation plate 18B, as shown in FIG. 3D. This is followed by repetition of the above operations, with the paper 154 being seasoned by air blown form the air blowing device 56 as the paper stack unit 156 is being lowered.

When the paper stack unit 156 is lowered further and the support fingers 52A reach the position of the following pulleys 50, support of the top separation plate 18A from the support fingers 52A is released. As can be seen from FIG. 1A and FIG. 1B, the top separation plate 18A is then lowered under its own weight, and the bottom ends of the spacers 22 make contact with the top face of the bottom separation plate 18B. At this stage the support fingers 52B support the paper stack unit 156.

When the paper stack unit 156 is lowered still further to a specific position, namely the position where the support fingers 52B reach the following pulleys 50, due to support of the paper stack unit 156 from the support fingers 52B being released, the paper stack unit 156 is then placed on the pallet 38. When a specific number of the paper stack units 156 have been mounted on the pallet 38, the pallet 38 supporting the paper stack units 156 and the pallet support table 34 are moved as a single unit, the pallet and the paper stack units 156 are removed from the pallet support table 34, and a new pallet 38 is set on the pallet support table 34.

Accordingly, the paper seasoning apparatus 12 of the present exemplary embodiment configures a portion of the inkjet recording apparatus 112. Further, in the present exemplary embodiment, the paper 154 is discharged from the paper discharge section 124 of the inkjet recording apparatus 112 is fed into the paper housing section 30 without being carried by an operative. Accordingly, present exemplary embodiment enables both seasoning and separation to be performed by the separation plates 18. More specifically, when the sheets of the paper 154 are fed in, lowering the bottom separation plate 18B at a specific lowering speed enables newly fed sheets of the paper 154 not to impinge on the paper 154 already supported on the bottom separation plate 18B, and the paper stacks 152 may be smoothly made.

However, in the paper seasoning apparatus 12 of the present exemplary embodiment, due to employing the top separation plates 18A in addition to the bottom separation plates 18B as the separation plates 18, the paper stack 152 can be housed in the paper housing space 20 during paper seasoning. Consequently, the air flow blown from the air blowing devices 56 may be made to better impact the side face of the paper stack 152 without being wasted and more efficient seasoning may be performed than would be the case were the paper housing space 20 to be configured without the top separation plate 18A. More specifically, in the present exemplary embodiment, the vertical separation D2 between the bottom separation plates 18B and the top separation plates 18A is set higher than the stack height H1 of the paper stack 152 in its natural state, permitting the spacing between the sheets of the paper 154 being blown by the air from the air blowing device 56 to open out wider, enabling sufficient volume of air to be blown between the sheets of the paper 154 and achieving even more efficient seasoning.

In the paper seasoning apparatus 12 of the present invention, since the top face of the bottom separation plate 18B, mounted with the paper stack 152, is also curved so as to protrude upwards, this also enables the shape of the paper to be corrected such that the paper 154 is made to be parallel to the direction of air blowing even when the paper 154 has a curl initially.

What is claimed is:

1. A paper seasoning apparatus comprising:

a paper housing section that stacks and houses sheets of paper that have been recorded with an image;

a separation plate introduction section that introduces separation plates into the paper housing section for separating stacked paper into paper stacks;

a separation plate support section that supports a plurality of the separation plates, and provides intervals between the separation plates greater than the stacked height of the paper stack; and an air blowing section that blows air onto a side face of the paper stacks separated by the separation plates in the paper housing section.

2. The paper seasoning apparatus of claim 1, wherein the separation plate support section lowers the separation plate by a lowering amount that matches the increase in height of the stack height of the paper stack.

3. The paper seasoning apparatus of claim 2, wherein the air blowing section blows air onto the side face of the paper stack while the paper stack is being lowered.

4. The paper seasoning apparatus of claim 2, wherein the separation plates are configured by a bottom separation plate on which the paper stack is stacked, and a top separation plate disposed above the bottom separation plate, and the bottom separation plate and the top separation plate are lowered such that the interval between the bottom separation plate and the top separation plate is provided greater than the stack height of the stacked paper.

5. The paper seasoning apparatus of claim 4, wherein the separation plate support section supports and lowers the bottom separation plate and the top separation plate, and at a specific lowering position, support of the top separation plate is released before support of the bottom separation plate is released.

6. The paper seasoning apparatus of claim 5, wherein leg portions are provided at the top separation plate for supporting the top separation plate on the bottom separation plate when support of the top separation plate from the separation plate support section has been released.

7. The paper seasoning apparatus of claim 6, wherein the leg portions are positioned at the outside of a side face of the paper stack and suppress the paper from thrashing about when air is blown from the air blowing section.

8. The paper seasoning apparatus of claim 3, wherein the separation plates are configured by a bottom separation plate on which the paper stack is stacked, and a top separation plate disposed above the bottom separation plate, and the bottom separation plate and the top separation plate are lowered such that the interval between the bottom separation plate and the top separation plate is provided greater than the stack height of the stacked paper.

9. The paper seasoning apparatus of claim 8, wherein the separation plate support section supports and lowers the bottom separation plate and the top separation plate, and at a specific lowering position, support of the top separation plate is released before support of the bottom separation plate is released.

10. The paper seasoning apparatus of claim 9, wherein leg portions are provided at the top separation plate for supporting the top separation plate on the bottom separation plate when support of the top separation plate from the separation plate support section has been released.

11. The paper seasoning apparatus of claim 10, wherein the leg portions are positioned at the outside of a side face of the paper stack and suppress the paper from thrashing about when air is blown from the air blowing section.

12. The paper seasoning apparatus of claim 1, wherein the separation plates are formed with a curve so as to protrude upwards when viewed from the air blowing section along the direction of air blow.

13. The paper seasoning apparatus of claim 1, further comprising:

a cover member that surrounds the separation plate support section on four sides, wherein the cover member is formed with an air blowing opening for introducing air blown from the air blowing section, and with an air discharge outlet for discharging air from inside the cover member.

14. An inkjet recording apparatus comprising:

an inkjet recording apparatus main body that ejects ink droplets onto paper and records images; and the paper seasoning apparatus of claim 1, provided at a discharge section for paper that has been recorded with images by the inkjet recording apparatus main body.

* * * * *